US006483065B1

(12) United States Patent
Gadre et al.

(10) Patent No.: US 6,483,065 B1
(45) Date of Patent: Nov. 19, 2002

(54) METHODS AND APPARATUS FOR CURRENT TRANSMISSION THROUGH A CIRCUIT BREAKER

(75) Inventors: Aniruddha Dattatraya Gadre, Niskayuna, NY (US); Jeffrey Dyson Lord, Burlington, IA (US); Liangfeng Xu, West Chester, OH (US); John Gardner Toney, Burlington, IA (US); William James Premerlani, Scotia, NY (US); Bharat S. Bagepalli, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/682,708

(22) Filed: Oct. 9, 2001

(51) Int. Cl.[7] ..... H01H 33/66

(52) U.S. Cl. ..... 218/118; 218/120; 218/124; 218/154

(58) Field of Search ..... 218/118, 120, 218/123–125, 127, 134, 137, 139, 140, 154, 155; 200/89.07, 275, 281

(56) References Cited

U.S. PATENT DOCUMENTS 2,965,734 A * 12/1960 Timmerman ..... 218/118
4,568,804 A 2/1986 Luehring
5,001,312 A * 3/1991 Barber et al. ..... 218/120
5,055,640 A * 10/1991 Lippi et al. ..... 218/120
5,422,450 A 6/1995 Miyazawa et al.
6,198,062 B1 3/2001 Mather et al.

* cited by examiner

*Primary Examiner*—Lincoln Donovan
(74) *Attorney, Agent, or Firm*—Patrick K. Patnode; Christian G. Cabou

(57) ABSTRACT

Methods and apparatus for facilitating current transmission through a circuit breaker are described. In an exemplary embodiment of the apparatus, a coupler that includes a copper conductive ring having an inner annular wall is provided. The coupler is electrically coupled to the line terminal. A bore extends through the ring, and the bore is sized so that the shaft can extend therethrough. A plurality of copper bristles extend radially inward from the ring inner annular wall, and the bristles are in electrical contact with the conductive ring. The bristles also are in electrical contact with shaft when shaft extends through ring bore. At least some bristles extend sufficiently radially inward from the ring inner wall so that free ends of at least some bristles are in electrical contact with the shaft when the shaft extends through the bore.

8 Claims, 1 Drawing Sheet

METHODS AND APPARATUS FOR CURRENT TRANSMISSION THROUGH A CIRCUIT BREAKER

BACKGROUND OF INVENTION

This invention relates generally to circuit breakers and more particularly, to transmitting current from a movable element of a circuit breaker to a line terminal.

A circuit breaker typically includes a stationary contact and a movable contact located in an arc chamber. The stationary contact is in electric circuit with a first line terminal, and the movable contact is in electric circuit with a second line terminal. For example, the movable contact is coupled to a conductive shaft that is movable towards and away from the stationary contact. The conductive shaft moves relative to the second line terminal, and the electrical connection between the conductive shaft and second line terminal permits such movement while maintaining electrical contact. For example, a spring-loaded finger arrangement can be provided that includes conductive spring-loaded fingers biased into electrical contact with the shaft.

During normal operation, i.e., when no fault occurs, the movable contact is in electrical contact with the stationary contact, and current at a rated level flows through the breaker. Specifically, current at the rate level flows from the first line terminal to the second line terminal via the stationary and movable contacts and the spring-loaded finger arrangement.

Once a fault occurs, the shaft is driven by the trip mechanism so that the movable contact moves away from the stationary contact to interrupt current flow. The spring-loaded finger arrangement permits relative movement of the shaft with respect to the second line terminal yet maintains electrical contact with the shaft. The shaft can be driven so that the movable contact moves towards and into electrical contact with the stationary contact by operating the closing mechanism. The spring-loaded finger arrangement also permits this relative movement of the shaft with respect to the second line terminal while maintaining electric continuity.

SUMMARY OF INVENTION

In one aspect, a coupler for coupling a movable shaft of a circuit breaker with a line terminal is provided. In an exemplary embodiment, the coupler includes a copper conductive ring having an inner annular wall, and is electrically coupled to the line terminal. A bore extends through the ring, and the bore is sized so that the shaft can extend therethrough.

A plurality of copper bristles extend radially inward from the ring inner annular wall, and the bristles are in electrical contact with the conductive ring. The bristles also are in electrical contact with shaft when shaft extends through ring bore. Specifically, at least some bristles extend sufficiently radially inward from the ring inner wall so that free ends of at least some bristles are in electrical contact with the shaft when the shaft extends through the bore.

In another aspect, a method of assembling a coupler and a movable shaft of a circuit breaker is provided. In an exemplary embodiment, the method includes the steps of aligning the shaft with the bore through the conductive ring, and inserting the shaft through the bore so that at least some bristles are in electrical contact with the shaft shaft. As explained above, the ring is in electrical circuit with line terminal. In operation, as the shaft moves relative to the coupling, the bristles maintain electrical contact between the shaft and the coupling.

DETAILED DESCRIPTION

Figure 1:
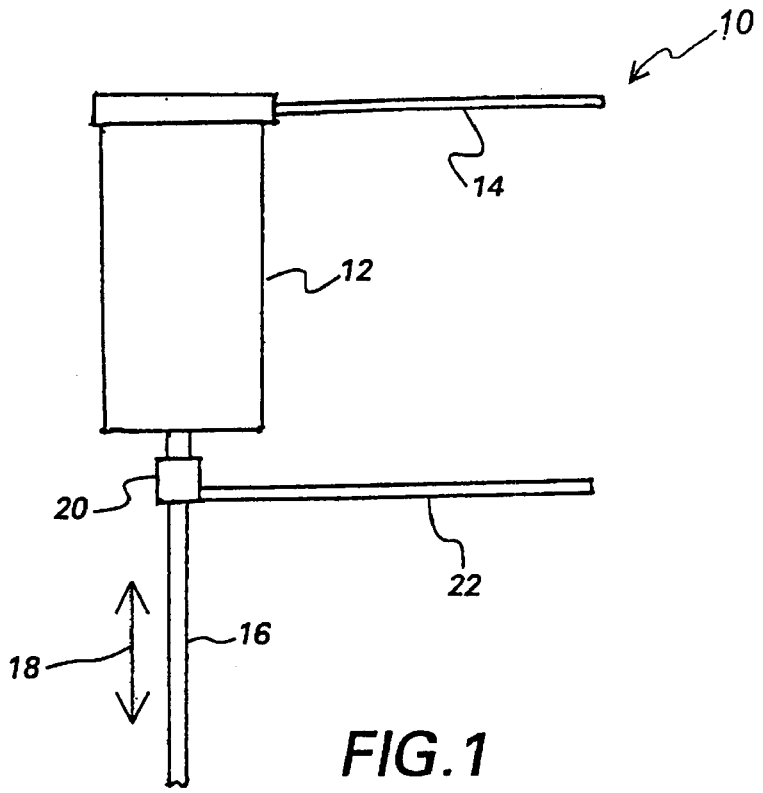
FIG. 1 is a side view of a portion of a breaker assembly.

FIG. 1 is a side view of a portion of a breaker assembly 10. Assembly 10 includes a breaker housing 12 that houses a movable contact and a stationary contact (the contacts are not shown). A first line terminal 14 is in electrical contact with the stationary contact. A movable shaft 16 extends into housing 12 and is coupled to the movable contact. Generally, shaft 16 is movable relative to housing 12 in the directions indicated by arrow 18.

Shaft 16 extends through a coupling 20, and coupling 20 is in electrical circuit with a second line terminal 22. Shaft 16 also moves relative to coupling 20. As shaft 16 moves relative to coupling 20, coupling 20 maintains electrical contact with shaft 16 so that a current can continue to flow from first line terminal 14, and through the stationary and movable contacts if such contacts are in circuit.

Figure 2:
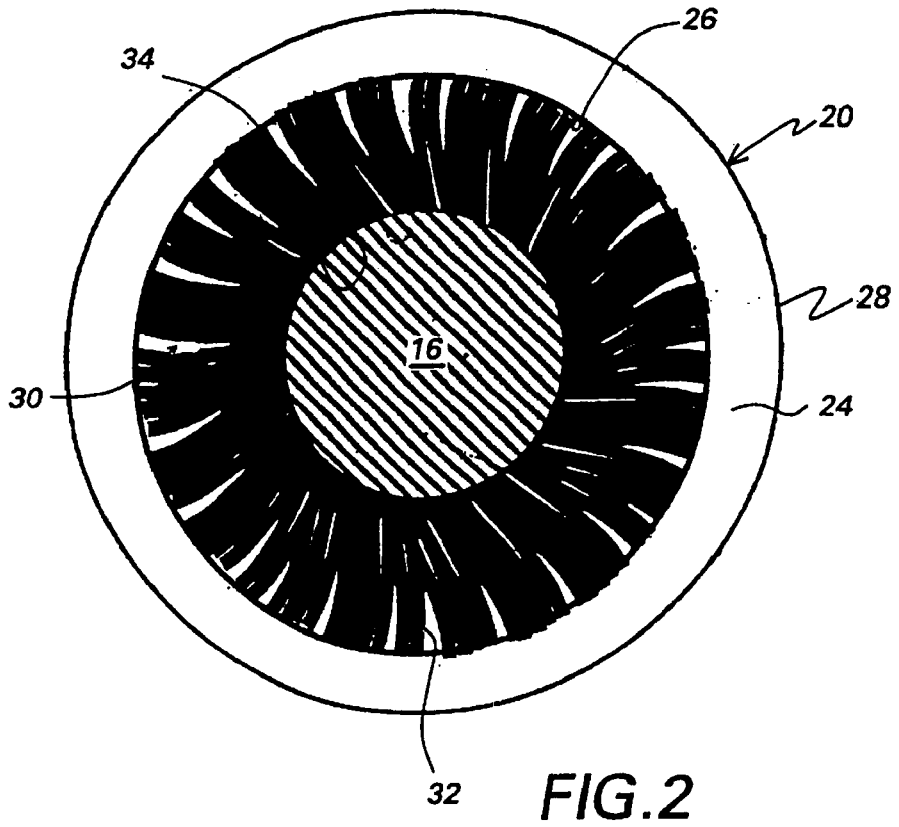
FIG. 2 is an end view of a coupler.

FIG. 2 is an end view of coupling 20 including a cross-sectional view of shaft 16 extending therethrough. Coupling 20 includes a copper conductive ring 24 having an inner annular wall 26. An outer annular wall 28 of coupling 20 is electrically coupled (e.g., welded) to line terminal 22 (FIG. 1). A bore 30 extends through ring 24, and bore 30 is sized so that shaft 16 can extend therethrough.

A plurality of copper bristles 32 extend radially inward from inner annular wall 26, and bristles 32 in electrical contact with conductive ring 24. In the exemplary embodiment, bristles 32 have an outer layer of silver and are welded to inner annular wall 26.

Bristles 32 are in electrical contact with shaft 16 when shaft 16 extends through ring bore 20. Specifically, at least some bristles 32 extend sufficiently radially inward from ring inner wall 26 so that free ends 34 of at least some bristles 32 are in electrical contact with shaft 16 when shaft 16 extends through bore 30. The number and size (e.g., cross-sectional area) of bristles 32 are selected so that bristles 32 do not inhibit the rated current flow through the breaker. In addition, the number and length of bristles 32 affects the loading on shaft 16 in that such bristles 32 resist motion of shaft. Therefore, the dimensions of bristles 32 are selected to place a desired loading on shaft 16 to reduce friction losses on shaft 16 during breaker opening and closing operation, compared to friction losses that occur with the spring loaded finger arrangements described above. In addition, bristles 32 are positioned so that bristles 32 maintain uniform contact with shaft 16 and so that if some bristles lose contact with shaft during motion, other bristles 32 maintain such contact with shaft 16.

To assemble coupling 20 and shaft 16, shaft 16 is aligned with conductive ring 24 and inserted through ring 24 so that at least some bristles 32 are in electrical contact with shaft 16. Ring 24 is in electrical circuit with line terminal 22 (FIG. 1). In operation, as shaft 16 moves relative to coupling 20, bristles 32 maintain electrical contact with shaft 16.

While the invention has been described in terms of various specific embodiments, those skilled in the art will recognize that the invention can be practiced with modification within the spirit and scope of the claims.

What is claimed is:

1. Apparatus for transmitting current from a movable element of a circuit breaker to a line terminal, said apparatus comprising:

a conductive ring having an inner annular wall, a bore extending through the ring, said bore sized so that the circuit breaker movable element can extend therethrough, said ring configured to be connected in an electrical circuit with the line terminal; and a plurality of bristles in electrical contact with said conductive ring and extending radially inward from said inner annular wall of said ring, said bristles configured to be in electrical contact with the movable element when the movable element extends through said ring bore.

2. Apparatus according to claim 1 wherein said conductive ring is copper.

3. Apparatus according to claim 1 wherein said bristles are copper.

4. Apparatus according to claim 1 wherein said bristles comprise an outer layer of silver.

5. Apparatus according to claim 1 wherein at least some of said bristles extend sufficiently radially inward from said ring inner wall so that free ends of at least some of said bristles are in electrical contact with the circuit breaker movable element when the movable element is positioned to extend through said bore.

6. A method for assembling a circuit breaker, the circuit breaker including a movable element and a conductive ring, the conductive ring having an inner annular wall and a plurality of bristles extending radially inward from the inner annular wall, said method comprising the steps of:

aligning the movable element with conductive ring; and inserting the movable element through the conductive ring so that at least some of the bristles are in electrical contact with the movable element.

7. A method according to claim 6 wherein the movable element is movable relative to the conductive ring.

8. A method according to claim 6 further comprising the step of securing the ring in an electrical circuit with a line terminal.

* * * * *